United States Patent [19]

Mattei et al.

[11] Patent Number: 4,675,069

[45] Date of Patent: Jun. 23, 1987

[54] DEVICE FOR FEEDING AND CUTTING STRIP LABELS

[75] Inventors: Riccardo Mattei; Alessandro Minarelli, both of Bologna, Italy

[73] Assignee: G.D Societa Per Azioni, Turin, Italy

[21] Appl. No.: 897,079

[22] Filed: Aug. 18, 1986

[30] Foreign Application Priority Data

Sep. 3, 1985 [IT] Italy ..... 3533 A/85

[51] Int. Cl.[4] ..... B65C 31/00

[52] U.S. Cl. ..... 156/510; 156/521; 226/53; 226/88; 226/62; 226/125

[58] Field of Search ..... 156/361, 542, 353, 350, 156/510, 521, 522; 226/53, 62, 88, 125, 126, 158

[56] References Cited

U.S. PATENT DOCUMENTS

| | | | |
|---|---|---|---|
| 2,169,058 | 8/1939 | Price | 226/52 X |
| 3,973,492 | 8/1976 | Black | 226/88 X |
| 4,197,799 | 4/1980 | Sato | 226/53 X |
| 4,453,999 | 6/1984 | Holland-Letz | 156/361 |
| 4,479,839 | 10/1984 | Tasma | 156/361 X |

*Primary Examiner*—David Simmons

*Attorney, Agent, or Firm*—Marshall, O'Toole, Gerstein, Murray & Bicknell

[57] ABSTRACT

A device for feeding and cutting a strip of labels, on which strip the labels are joined integral with one another along lines at least a center portion of which consists of a slit. The labels are fed successively in two stages towards a cutting position; in the first of which stages, the label, is fed forward by means of a feeding device 051570752which, positively engaging the rear edge of the label, brings it into the vicinity of the cutting position; and in the second of which stages, the cutting position of the label is regulated by means of a conveyor roller which engages the uncut label by means of suction and feeds it forward so as to cause the front edge of the following label to be brought into "gentle" impact with stop elements on a fixed cutting blade.

8 Claims, 5 Drawing Figures

DEVICE FOR FEEDING AND CUTTING STRIP LABELS

BACKGROUND OF THE INVENTION

The present invention relates to a device for feeding and cutting strip labels.

The device according to the present invention may be used to advantage, though not exclusively, on cigarette packing machines, for feeding a wrapping line with labels consisting, for example, of revenue stamps or sealing strips. Cigarette packing machines are known to employ strips of labels on which each label is joined to the adjacent labels along lines at least a centre portion of which consists of a slit. Each strip is normally wound into a coil and connected to a feeding and cutting device, which reels the strip off the said coil and feeds it, in step-by-step manner, towards a cutting position where the end label on the strip is separated from the following labels by means of a device normally consisting of a fixed and a mobile blade.

On known feeding and cutting devices, the uncut label is usually fed towards the cutting position by parting the edges of the said slit between two adjacent labels, and by positively engaging one of the parted edges by means of a slide mechanism, which pushes the uncut label onto a stop element which engages and arrests the label in the cutting position.

A major drawback on known feeding devices of the aforementioned type is that they fail to provide for precise positioning of the label in the cutting position, and/or for preventing damage to the label over a given cutting rate, which has been amply exceeded on modern cigarette packing machines designed to produce over ten packets a second.

To be more precise, as each uncut label is fed forward by the said slide mechanism so as to engage the said stop element, the impact between the said stop element and the edge of the label may result in damage to the label and/or in the entire strip being jolted backwards when the cutting rate and, therefore, the operating speed of the said slide mechanism, for a given label length, exceeds the said given rate.

SUMMARY OF THE INVENTION

The aim of the present invention is to provide a device for feeding and cutting strip labels, designed to overcome the aforementioned drawbacks.

With this aim in view, according to the present invention, there is provided a device for feeding and cutting a strip of labels secured integral with one another along joining lines at least the centre portion of which is defined by a slit; the said device being characterised by the fact that it comprises feeding means for feeding the said strip in a given direction; a fixed cutting blade; first and second supporting means for the said strip, located respectively up- and downstream from the said fixed blade in the travelling direction of the said strip and defining a sliding surface for the said strip; grip feeding means designed to travel in reciprocating manner along the said first supporting means and to open and close alternately for gripping the said strip, by parting the slit between a first and second of the said labels, and for jogging the said strip forward along the said first and second supporting means in steps shorter in length than one of the said labels; stop means located on the said fixed blade and designed to cooperate with the free end of the said first label; releasing means designed to move together with the said first grip feeding means, so as to release the said free end of the said first label from the said stop means, as the said strip is fed forward one said step; and a mobile blade designed to cooperate with the said fixed blade, in such a manner as to cut the said strip along the joining line between the said first and the said second label; the said second supporting means being designed to move together with the said mobile blade, and comprising engaging means designed to engage the said first label by friction and in possibly sliding manner, and to feed the said strip forward so as to engage and maintan the said parted slit engaged with the said stop means.

BRIEF DESCRIPTION OF THE DRAWINGS

One embodiment of the present invention will be described, by way of a non-limiting example, with reference to the accompanying drawings, in which.

DETAILED DESCRIPTION OF THE INVENTION

Figure 1:
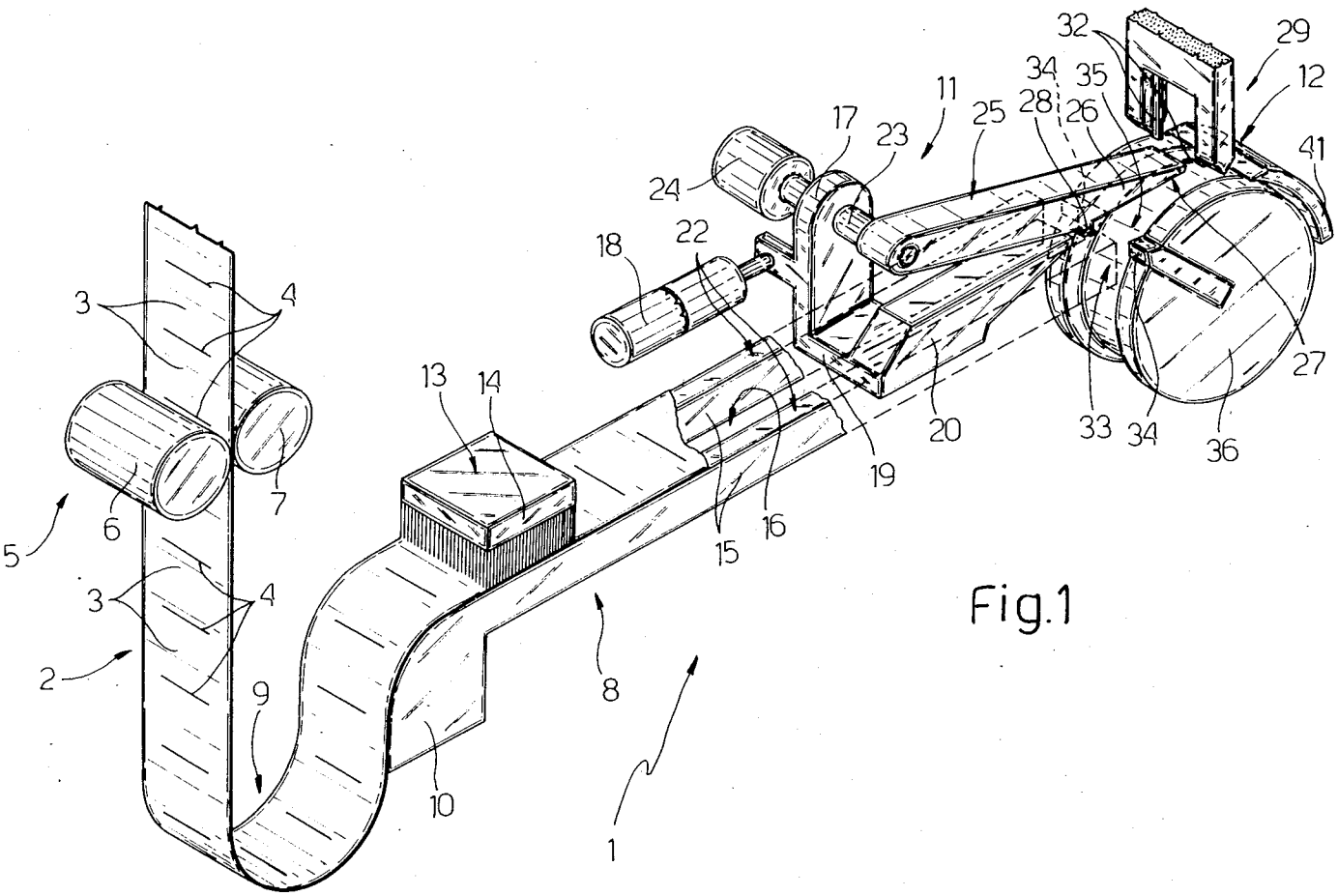
FIG. 1 shows a schematic view in perspective, with parts removed for simplicity, of a device for feeding and cutting strip labels according to the teachings of the present invention.

Number 1 in FIG. 1 indicates a device for feeding and cutting a continuous strip 2 of labels 3, each of which labels 3 is partially separated from the adjacent labels 3 by a slit 4 extending only over the centre portion of strip 2.

Device 1 comprises a feeding unit 5 consisting of two counter-rotating rollers 6 and 7 arranged tangent with each other and which, when activated, grip strip 2 and unwind it off a coil (not shown) located over feeding unit 5.

Device 1 also comprises a supporting means consisting of a bed 8 located beside feeding unit 5 and displaced laterally in relation to the same, so as to enable strip 2 to form a loop 9 between feeding unit 5 and a vertical appendix 10 projecting downwards from the input end of bed 8 in such a manner as to support and guide the output end of loop 9.

As shown in FIG. 1, bed 8 is fitted with a grip feeding device, indicated as a whole by 11 and designed to engage and feed strip 2 in step-by-step manner towards a cutting unit 12, and a brake device 13 cooperating with the upper surface of bed 8 for tensioning the portion of strip 2 extending along bed 8 upstream from feeding device 11. Brake device 13 comprises a brush 14 the bristles of which cooperate in sliding manner with the upper surface of strip 2 so as to cause strip 2 to adhere to bed 8. The said bed comprises two substantially horizontal, parallel rails 15 arranged side by side so as to define, inbetween, a slot 16 extending along bed 8 and constituting a slideway for feeding device 11.

Feeding device 11 comprises a slide or supporting element 17 arranged substantially vertically on one side of bed 8 and designed to travel, in reciprocating manner along the said bed 8 by virtue of an actuating device 18, between a rear position, substantially adjoining brake device 13, and a forward position described in more detail later on. From the lower end of supporting element 17, there projects laterally a substantially horizontal appendix 19 extending beneath bed 8 and having its free end connected to a fixed jaw or tooth 20 lying in a substantially vertical plane. Tooth 20 engages, in sliding manner, slot 16 and extends upwards to a point at which a free end portion 21 coincides with a point slightly over the upper sliding surface 22 of bed 8 along which strip 2 travels.

On the top end of supporting element 17, over surface 22, there is connected, in rotary manner, a shaft 23 parallel to the plane of the surface 22 and extending over the same perpendicular to the travelling direction of strip 2 along bed 8. Shaft 23 is rocked about its own axis by an actuating device 24 the operating frequency of which is substantially equal to that of actuating device 18.

On the free end of shaft 23, over slot 16, there is fitted a mobile jaw or lever 25, the end portion 26 of which, hereinafter referred to also as a releasing means, is beak-shaped and presents an inclined lower surface 27 designed to move, with lever 25, between a lowered position, wherein surface 27 is substantially aligned with surface 22 but with a free end portion projecting slightly beneath surface 22, and a raised position, wherein surface 27 is raised completely over surface 22.

Figure 3:
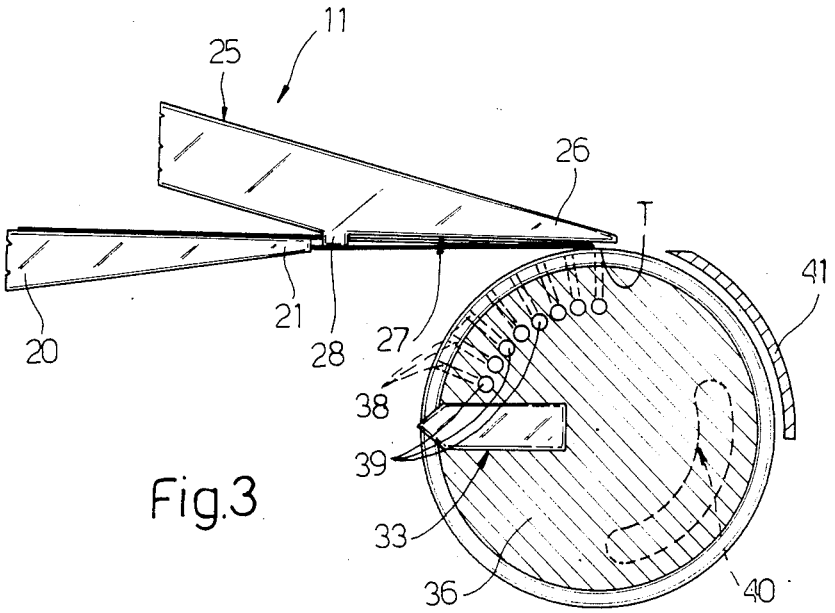
FIGS. 3, 4 and 5 show schematic views of a FIG. 1 detail in three distinct operating positions.

As shown, particularly in FIG. 3, when arranged in the said lowered position, substantially the whole of surface 27 projects forward in relation to the end portion 21 of tooth 20 in the travelling direction of strip 2 along bed 8. From the end of surface 27 adjoining end portion 21 of tooth 20, there projects downwards a tooth 28 which, with surface 27 in the said lowered position, is located just in front of end portion 21 of tooth 20 and extends through surface 22 into slot 16.

Figure 2:
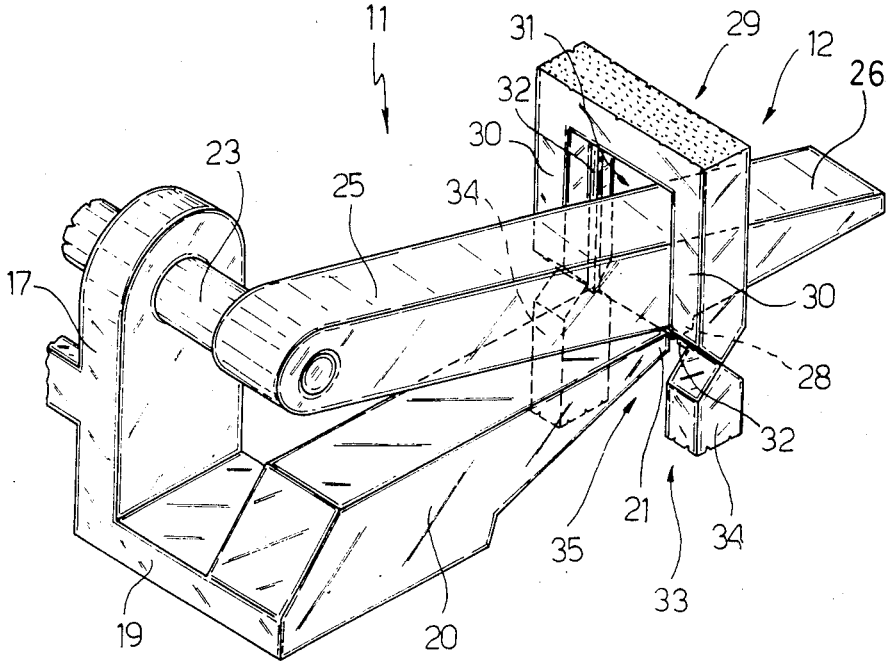
FIG. 2 shows an enlarged view in perspective of a detail in FIG. 1.

As shown, particularly in FIG. 2 onwards, cutting unit 12 comprises a fixed blade 29 located over surface 22 and substantially in the shape of an upside-down "U". In more detail, fixed blade 29 comprises two cutting arms 30 the free cutting ends of which are substantially located flush with surface 22, crosswise in relation to strip 2, and slightly downstream, in the travelling direction of strip 2, in relation to the position of end portion 21 of tooth 20, when tooth 20 is in the said forward position. Arms 30 are separated by an opening 31 of substantially the same width as slot 16, and are arranged parallel with each other and facing the continuous longitudinal side portions of strip 2 extending on opposite sides of the centre portion of strip 2 having slits 4.

To the surface of each arm 30 facing opening 31, there is connected a stop element 32 consisting of a rod integral with respective arm 30 and projecting, from the free end of the same, downwards through surface 22 and into slot 16 by an amount just short of that by which the free end portion of surface 27 projects downwards in relation to surface 22.

Cutting unit 12 also comprises a mobile blade 33 which, like fixed blade 29, comprises two cutting arms 34 separated by an opening 35 of the same width as opening 31, and designed to move into a cutting position wherein arms 34 are arranged facing and in line with arms 30 and cooperate with the cutting ends of the same in such a manner as to cut the said continuous side portions of strip 2 on either side of slit 4.

Mobile blade 33 projects radially outwards from a supporting means consisting of a conveyor roller 36 mounted for rotation about a horizontal axis perpendicular to rails 15, and located beneath surface 22 and downstream from bed 8 in such a position that the periphery of roller 36 is substantially tangent at point T (FIG. 3) with the said free end portion of surface 27 when lever 25 is in the said lowered position and feeding device 11 in the said rear position. The distance between point T and end 21 of tooth 20 in the said rear position is at least equal to the length of a label 3.

Conveyor roller 36 turns about its own axis in time with feeding device 11, that is, in such a manner as to make a complete turn about its own axis in the time taken by feeding device 11 to perform a complete forward-return stroke. During such rotation, at point T, the outer periphery of roller 36 travels in the same direction as strip 2 along surface 22.

A sector 37 of conveyor roller 36, located immediately downstream from mobile blade 33 and of substantially the same length as a label 3, presents a number of radial suction holes 38, hereinafter referred to also as engaging means, communicating with respective axial ducts 39 extending inside roller 36. Ducts 39 are designed to communicate successively with activating means consisting of a fixed, curved end slot 40 of a suction circuit (not shown), which slot 40 is located, in relation to point T, in such a manner as to communicate with the first hole 38 as feeding device 11 reaches the said forward position. For guiding label 3 as it travels round the periphery of roller 36, roller 36 is provided with a fixed outer guide 41 extending about the periphery of roller 36 from a point adjacent to point T and downstream from the same in the travelling direction of label 3.

Feeding and cutting device 1 will now be described starting from an operating position, hereinafter referred to as the starting position, assumed just prior to reaching the operating position shown in FIG. 3.

In the said starting position, feeding device 11 is arranged in the said rear position, with end portion 21 of tooth 20 located slightly upstream from slit 4, and lever 25 in the raised position, with tooth 28 slightly downstream from the said slit 4.

Starting from the above position, lever 25 is lowered so as to engage, with tooth 28 and end portion 26, the upper surface of a label 3 on the end of strip 2, the said label being arranged on surface 22 with its rear end immediately downstream from end portion 21 of tooth 20, and its front end contacting, substantially at point T, stop elements 32 and the outer periphery of roller 36.

Lowering lever 25 parts the slit 4 at the rear end of the said end label 3 and, at the same time, lowers the front end of the label underneath stop elements 32 and aligns the said front end with the passage defined by guide 41 about roller 36.

Figure 4:
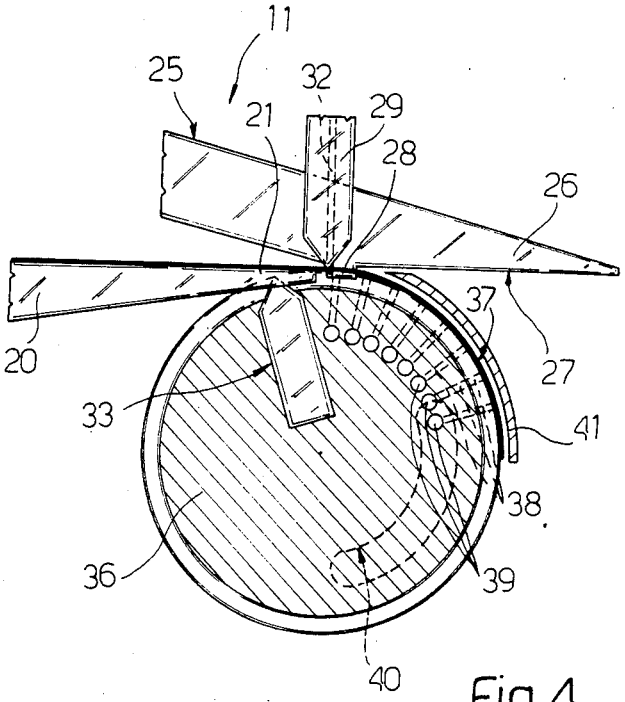

Feeding device 11 is then moved into the said forward position, which causes lever 25 to move through opening 31 in such a manner as first to cause end portion 21 of tooth 20 to contact the lowered rear end of the said end label 3, and then to push forward the entire strip 2 so as to position the said rear end of end label 3 upstream from and close to fixed blade 29, as shown in FIG. 4.

Figure 5:
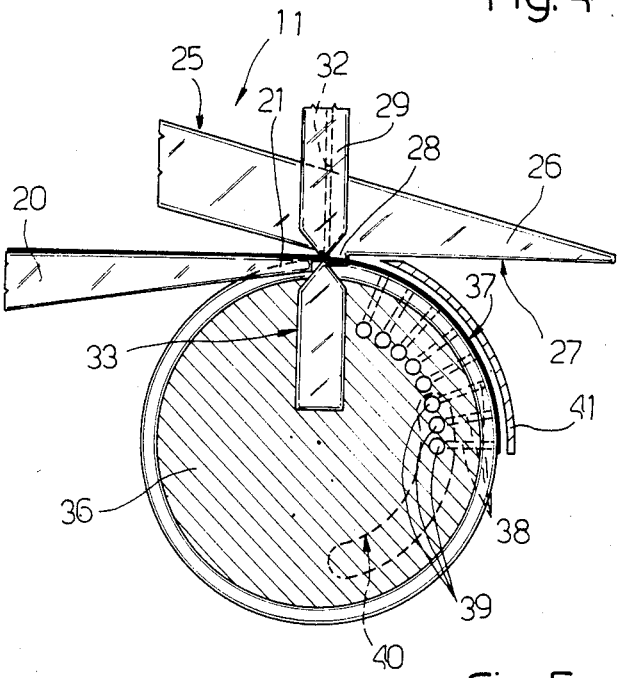

Once feeding device 11 is in the said forward position, a front portion of end label 3 is engaged underneath guide 41, and roller 36 is set at such an angle as to cause the first of holes 38 to cooperate with an intermediate portion of end label 3, and respective duct 39 to commence communication with suction slot 40. Consequently, end label 3, together with the whole of strip 2, continues moving forward, even after feeding device 11 has been stopped in the said forward position, by virtue of the forward thrust exerted by roller 36 (FIG. 5).

Feeding device 11 is then returned to the said rear position, lever 25 is raised, and further forward displacement of strip 2, as described above, ceases when the front edge of label 3 adjoining the said end label contacts stop elements 32 on fixed blade 29. Further angular displacement of roller 36 causes the said end label 3 to slide along the periphery of roller 36 until mobile blade 33, moving into alignment with fixed blade 29 as shown in FIG. 5, separates end label 3 from the rest of strip 2, thus enabling roller 36 to carry off end label 3, leaving the rest of strip 2 in the said starting position on surface 22. At each repetition of the above operating cycle, a further label 3 is cut off strip 2 exactly along the line of slit 4, by virtue of the position adjustment performed by roller 36 as soon as feeding device 11 moves into the said forward position.

Clearly, therefore, forward feeding of each label 3 into the cutting position, wherein the label 3 following the one to be cut is arranged with its front edge contacting stop elements 32, is performed in two successive stages. During the first stage, the label 3 to be cut is fed forward by device 11, which positively engages the rear edge of label 3 and pushes it forward practically into the said cutting position.

During the second stage, the label 3 to be cut is moved further forward, by suction and in sliding manner, by roller 36 until it comes to stop "gently" contacting stop elements 32.

Such gentle impact prevents strip 2 from being jolted backwards, prevents tearing of the labels along the front edge, and enables each label being cut to be set perfectly in the said cutting position.

We claim:

1. A device for feeding and cutting a strip (2) of labels (3) secured integral with one another along adjoining lines at least the centre portion of which is defined by a slit (4); the said device being characterised by the fact that it comprises feeding means (5) for feeding the said strip (2) in a given direction; a fixed cutting blade (29); first and second supporting means (8; 36) for the said strip (2), located respectively up- and downstream from the said fixed blade (29) in the travelling direction of the said strip (2) and defining a sliding surface (22) for the said strip (2); grip feeding means (11) designed to travel in reciprocating manner along the said first supporting means (8) and to open and close alternately for gripping the said strip (2), by parting the slit (4) between a first and second of the said labels (3), and for jogging the said strip forward along the said first and second supporting means (8; 36) in steps shorter in length than one of the said labels (3); stop means (32) located on the said fixed blade (29) and designed to cooperate with the free end of the said first label (3); releasing means (26) designed to move together with the said first grip feeding means (11), so as to release the said free end of the said first label (3) from the said stop means (32), as the said strip (2) is fed forward one said step; and a mobile blade (33) designed to cooperate with the said fixed blade (29), in such a manner as to cut the said strip (2) along the joining line between the said first and the said second label (3); the said second supporting means (36) being designed to move together with the said mobile blade (33), and comprising engaging means (38) designed to engage the said first label (3) by friction and in possibly sliding manner, and to feed the said strip (2) forward so as to engage and maintain the said parted slit (4) engaged with the said stop means (32).

2. A device as claimed in claim 1, characterised by the fact that the said first supporting means comprise a bed (8) supporting, in sliding manner, the said grip feeding means (11); the upper surface (22) of the said bed forming part of the said sliding surface.

3. A device as claimed in claim 1, characterised by the fact that the said second supporting means comprise a conveyor roller (36) located beneath the said fixed blade (29); the said conveyor roller (36) supporting, in rigidly connected manner, the said mobile blade (33) which projects substantially radially from the periphery of the said conveyor roller (36).

4. A device as claimed in claim 3, characterised by the fact that the said engaging means comprise suction means (38) arranged about the periphery of the said conveyor roller (36) downstream from the said mobile blade (33) in the rotation direction of the said conveyor roller (36); the said conveyor roller (36) being timed to the said grip feeding means (11) in such a maner as to make a complete turn about its own axis in the time taken by the said grip feeding means (11) to perform a complete forward-return stroke; activating means (40) being provided for activating the said suction means (38) substantially upon completion of the forward stroke by the said grip feeding means (11).

5. A device as claimed in claim 1, characterised by the fact that the said fixed blade (29) is substantially U-shaped with its concave side facing the said second supporting means (36); the said fixed blade (29) comprising two arms (30) having free cutting ends for engaging the portions of each said joining line on opposite sides of the respective said slit (4); the said two arms (30) combining to define an opening (31) through which the said grip feeding means (11) travel.

6. A device as claimed in claim 5, characterised by the fact that the said stop means comprise at least one stop element (32) integral with a respective said arm (30) on the said fixed blade (29), the said stop element (32) being located inside the said opening (31) and projecting axially from the respective said arm (30) and through the said sliding surface (22) by a given amount.

7. A device as claimed in claim 1, characterised by the fact that the said grip feeding means (11) comprise slide means (17) mounted so as to slide in reciprocating manner along the said first supporting means (8); a first jaws (20) supported on the said slide means (17) and extending along the said first supporting means (8) and on one side of the said sliding surface (22), a free end (21) of the said first jaw (20) extending across the said sliding surface (22); a second jaw (25) supported on the said slide means (17) and located facing the said first jaw (20) and on the opposite side to the same in relation to the said sliding surface (22); and activating means (24) for moving the said jaws (20, 25) mutually between an open and a closed position; the said second jaw (25) having an end portion (26) which, when the said jaws (20, 25) are in the said closed position, projects downstream from the said first jaw (20) in the travelling direction of the said strip (2); a tooth (28) projecting transversely from the said end portion (26) of the said second jaw (25), the said tooth (28) extending, when the said jaws (20, 25) are in the said closed position, through the said surface (22) on which slides the said strip (2).

8. A device as claimed in claim 6, characterised by the fact that the said end portion (26) of the said second jaw (25) is of substantially the same length as a said label (3), is located on the same side of the said sliding surface a the said fixed blade (29), and comprises a free end portion which, when the said jaws (20, 25) are in the said closed position, extends through the said sliding surface (22) by an amount just short of the said given amount b which projects each said stop element (32); the said free end portion of the said second jaw (25) constituting the said releasing means.

* * * * *

UNITED STATES PATENT AND TRADEMARK OFFICE

CERTIFICATE OF CORRECTION

PATENT NO. : 4,675,069

DATED : June 23, 1987

INVENTOR(S) : RICCARDO MATTEI ET AL

It is certified that error appears in the above-identified patent and that said Letters Patent is hereby corrected as shown below:

On the patent cover sheet, item [73], change "Turin" to -- Bologna --.

Signed and Sealed this

Ninth Day of February, 1988

*Attest:*

DONALD J. QUIGG

*Attesting Officer*

*Commissioner of Patents and Trademarks*